US009239569B2

(12) United States Patent
Cabezas Jurin et al.

(10) Patent No.: US 9,239,569 B2
(45) Date of Patent: Jan. 19, 2016

(54) TIMEPIECE BALANCE SPRING

(71) Applicant: ETA SA Manufacture Horlogere Suisse, Grenchen (CH)

(72) Inventors: Andres Cabezas Jurin, Yverdon (CH); Kaspar Trumpy, Soleure (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/612,598

(22) Filed: Feb. 3, 2015

(65) Prior Publication Data

US 2015/0234355 A1 Aug. 20, 2015

(30) Foreign Application Priority Data

Feb. 14, 2014 (EP) ..... 14155196

(51) Int. Cl.
*G04B 17/06* (2006.01)

(52) U.S. Cl.
CPC ..... *G04B 17/063* (2013.01); *G04B 17/066* (2013.01)

(58) Field of Classification Search
CPC ..... G04B 17/06; G04B 17/063; G04B 17/066
USPC ..... 368/169, 175
See application file for complete search history.

(56) References Cited

U.S. PATENT DOCUMENTS

| | | | | |
|---|---|---|---|---|
| 209,642 | A | 11/1878 | Berlitz et al. | |
| 8,562,206 | B2 * | 10/2013 | Bossart | G04B 17/066 368/175 |
| 2005/0281137 | A1 * | 12/2005 | Bourgeois | F16F 1/021 368/175 |
| 2009/0016173 | A1 * | 1/2009 | Hessler | C03C 15/00 368/140 |
| 2010/0027382 | A1 | 2/2010 | Daout et al. | |
| 2011/0069591 | A1 * | 3/2011 | Daout | G04B 17/20 368/175 |
| 2011/0249537 | A1 | 10/2011 | Daout et al. | |
| 2012/0075963 | A1 * | 3/2012 | Zaugg | G04B 17/26 368/127 |

FOREIGN PATENT DOCUMENTS

| | | |
|---|---|---|
| BE | 526689 | 3/1954 |
| CH | 327796 | 2/1958 |
| CH | 706 087 A1 | 8/2013 |
| EP | 1 431 844 A1 | 6/2004 |
| EP | 2 151 722 A1 | 2/2010 |
| EP | 2 299 336 A2 | 3/2011 |

OTHER PUBLICATIONS

European Search Report issued Nov. 5, 2014, in Patent Application No. EP 14 15 5196, filed Feb. 14, 2014 (with English-language translation).

* cited by examiner

*Primary Examiner* — Vit W Miska
(74) *Attorney, Agent, or Firm* — Oblon, McClelland, Maier & Neustadt, L.L.P.

(57) ABSTRACT

Balance spring including, tangent to each other:
- a first inner coil at a first angle at the center and of decreasing section in a first ratio;
- a second coil at a second angle at the center and of constant section;
- a third coil at a third angle at the center and of increasing section in a third ratio;
- a fourth coil at a fourth angle at the center and of constant section;
- a fifth coil at a fifth angle at the center and of increasing section in a fifth ratio;
- a sixth outer coil at a sixth angle at the center and of increasing section in a sixth ratio.

In a variant, a seventh more rigid segment deviates from this sixth coil.
Movement including this balance spring.
Watch including this movement.

30 Claims, 6 Drawing Sheets

TIMEPIECE BALANCE SPRING

FIELD OF THE INVENTION

This application claims priority from European Patent Application No. 14155196.0 filed on Feb. 14, 2014, the entire disclosure of which is hereby incorporated herein by reference.

The invention concerns an improved timepiece balance spring.

The invention concerns a timepiece movement including a control stem defining an oriented direction, a main plate carrying a stud and means of guiding at least one sprung balance regulating mechanism pivoting about an axis and said sprung balance includes at least one such balance spring.

The invention concerns a watch including at least one sprung balance regulating mechanism pivoting about an axis and said sprung balance including at least one such balance spring, and/or said watch including at least one such movement.

The invention concerns the field of mechanical watch movements, wristwatches and pocket watches, and more particularly sprung balance regulating mechanisms.

BACKGROUND OF THE INVENTION

Obtaining and maintaining the isochronism of a mechanical timepiece oscillator are major difficulties of watch design. The quality of the balance spring is an essential factor of the precision of a timepiece. Numerous advances have been made, particularly by implementation of twisting inner or terminal coils.

Other research has made it possible to maintain a flat development of the balance spring. Thus, BE Patent No 526689 in the name of Emile MICHEL, or CH Patent No 327796 in the name of ASUAG propose a balance spring wherein at least one part of the strip has a straight section different from that of the rest of the strip, in order to obtain, during operation, a concentric development of the balance spring. However, the teaching is very general, and those skilled in the art have to perform lengthy experiments to define suitable parameters.

EP Patent Application No 2299336 A2 in the name of ROLEX SA discloses a flat balance spring for a timepiece balance including a wound coil, arranged to ensure a substantially concentric development of the balance spring, and almost zero force exerted on the pivots and the rigid point of support, during a rotation of less than 360° of the inner end relative to the outer end thereof in both directions from its rest position. The rigidity of the strip decreases gradually and over more than 360°, from each end thereof, and more specifically from, on the one hand, a point located between the inner end and second coil thereof, and on the other hand, from a point located between the outer end and penultimate coil thereof, the lowest rigidity being located in the median part of the strip.

EP Patent Application No 2151722 A1 in the name of ROLEX SA concerns a balance spring including a plurality of strips wound into a spiral, in one piece with a common collet of larger section than the sections of the coils of the various strips, and in one piece with an outer common ring of larger section than the sections of the coils of the various strips.

SUMMARY OF THE INVENTION

The invention proposes to define a balance spring making it possible to obtain excellent concentricity of the balance spring in expansion and in contraction, ensuring improvement in the chronometry of the timepiece which incorporates a balance spring of this type.

The design according to the invention must be able to be applied to <<MEMS>> or <<LIGA>> manufacturing in order to exploit the advantages peculiar to silicon, quartz, diamond or similar materials. Thus, the invention endeavours to define a balance spring geometry with an entirely flat configuration, with no twisting and with no change in concavity, to ensure improved behaviour in service.

To this end, the invention concerns an improved timepiece balance spring, characterized in that said balance spring includes in succession and forming a continuous band, from an upstream inner end, an inner coil of decreasing section between a first section at its inner end and a second section at its junction with the next coil and said inner coil developing over less than one turn, followed by a series of coils each of whose section is always greater than or equal to that of the immediately preceding coil, and whose second coil has a section greater than or equal to said second section, and including at least one coil of increasing section, and characterized in that said improved timepiece balance spring includes, in succession, from an inner end and with angles at the center relative to an axial reference which are tangent to each other and all having a concavity facing the axial reference and forming a continuous band:

- a first inner coil to a first point, at a first angle at the center and of decreasing section in a first ratio;
- a second coil to a second point, at a second angle at the center and of constant section;
- a third coil to a third point, at a third angle at the center and of increasing section in a third ratio;
- a fourth coil to a fourth point, at a fourth angle at the center and of constant section;
- a fifth coil to a fifth point, at a fifth angle at the center and of increasing section in a fifth ratio;
- a sixth outer coil to a sixth point, at a sixth angle at the center and of increasing section in a sixth ratio.

In a particular variant, said balance spring also includes a seventh segment between said sixth point and a seventh point at a seventh angle at the center, of greater or equal section to that of said sixth coil at said sixth point, deviating from the preceding coils, and forming an angle of deviation with the tangent of said sixth coil at said sixth point.

The invention also concerns an improved timepiece balance spring, characterized in that said balance spring includes in succession and forming a continuous band, from an upstream inner end, an inner coil of decreasing section between a first section at its inner end and a second section at its junction with the next coil and said inner coil developing over less than one turn, followed by a series of coils whose second coil is of greater or equal section to said second section, and wherein at least one of said coils is of increasing section, and characterized in that said balance spring includes, in succession, from an inner end and with angles at the center relative to an axial reference which are tangent to each other and all having a concavity facing said axial reference and forming a continuous band:

- a first inner coil to a first point, at a first angle at the center and of decreasing section in a first ratio;
- a second coil to a second point, at a second angle at the center and of constant section;
- a third coil to a third point, at a third angle at the center and of increasing section in a third ratio;
- a fourth coil to a fourth point, at a fourth angle at the center and of constant section;

a fifth coil to a fifth point, at a fifth angle at the center and of increasing section in a fifth ratio;

a sixth outer coil to a sixth point, at a sixth angle at the center and of increasing section in a sixth ratio, characterized in that said balance spring can be divided and for this purpose includes fracture lines arranged to reduce its length, at the distal outer end of its outer coil, which is formed, either by said sixth outer coil, or by a seventh segment comprised in said balance spring between said sixth point and a seventh point, at a seventh angle at the center, of greater or equal section to that of said sixth coil at said sixth point, deviating from the preceding coils, and forming an angle of deviation with the tangent of said sixth coil at said sixth point.

The invention concerns a timepiece movement including a control stem defining an oriented direction, a main plate carrying a stud and means of guiding at least one sprung balance regulating mechanism pivoting about an axis and said sprung balance includes at least one such balance spring.

The invention concerns a watch including at least one sprung balance regulating mechanism pivoting about an axis and said sprung balance including at least one such balance spring, and/or said watch including at least one such movement.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

The invention includes an improved timepiece balance spring 1.

According to the invention, this improved timepiece balance spring 1 includes, in succession and forming a continuous band, from an upstream inner end, an inner coil of decreasing section between a first section at its inner end and a second section at its junction with the next coil and said inner coil developing over less than one turn, followed by a series of coils each always of greater or equal section to the immediately preceding coil, and whose second coil is of greater or equal section to said second section, and including at least one coil of increasing section.

Figure 1:
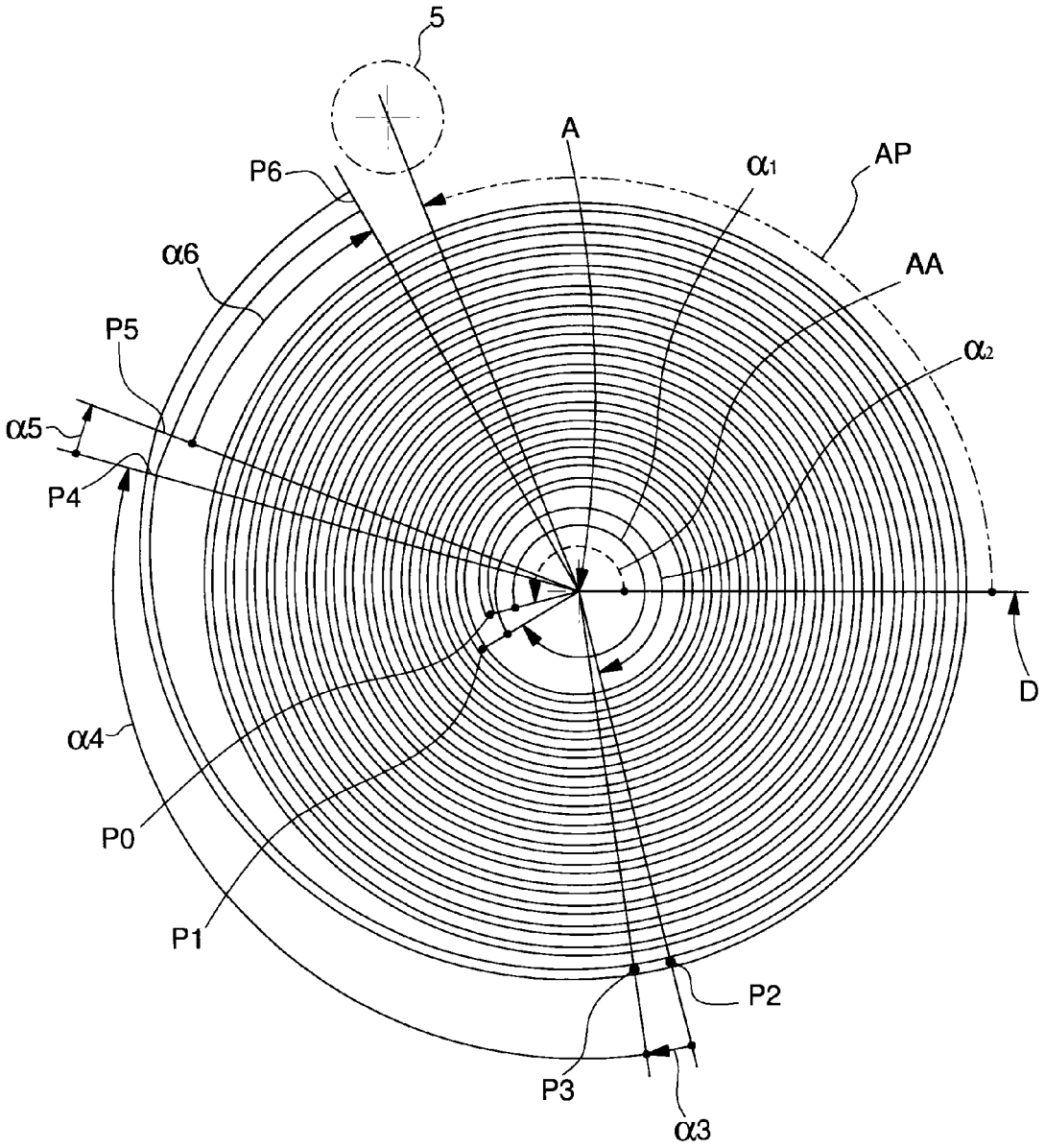
FIG. 1 shows a schematic plan view of a balance spring according to the invention, positioned relative to an axial direction of oscillation, and relative to an oriented direction which conventionally corresponds to the direction of a control stem of a watch movement, and relative to a stud for attachment to a main plate of the movement (not shown).

More specifically, and as seen in particular in FIG. 1, this balance spring 1 includes in succession, from an inner end P0 and with angles at the center relative to an axial reference A, which are tangent to each other, and all having a concavity facing axial reference A and forming a continuous band:

a first inner coil to a first point P1, at a first angle at the center $\alpha$1 and of decreasing section in a first ratio R1;

a second coil to a second point P2, at a second angle at the center $\alpha$2 and of constant section;

a third coil to a third point P3, at a third angle at the center $\alpha$3 and of increasing section in a third ratio R3;

a fourth coil to a fourth point P4, at a fourth angle at the center $\alpha$4 and of constant section;

a fifth coil to a fifth point P5, at a fifth angle at the center $\alpha$5 and of increasing section in a fifth ratio R5;

a sixth outer coil to a sixth point P6, at a sixth angle at the center $\alpha$6 and of increasing section in a sixth ratio R6.

The second coil is formed in a regular spiral, over several turns.

Figure 2:
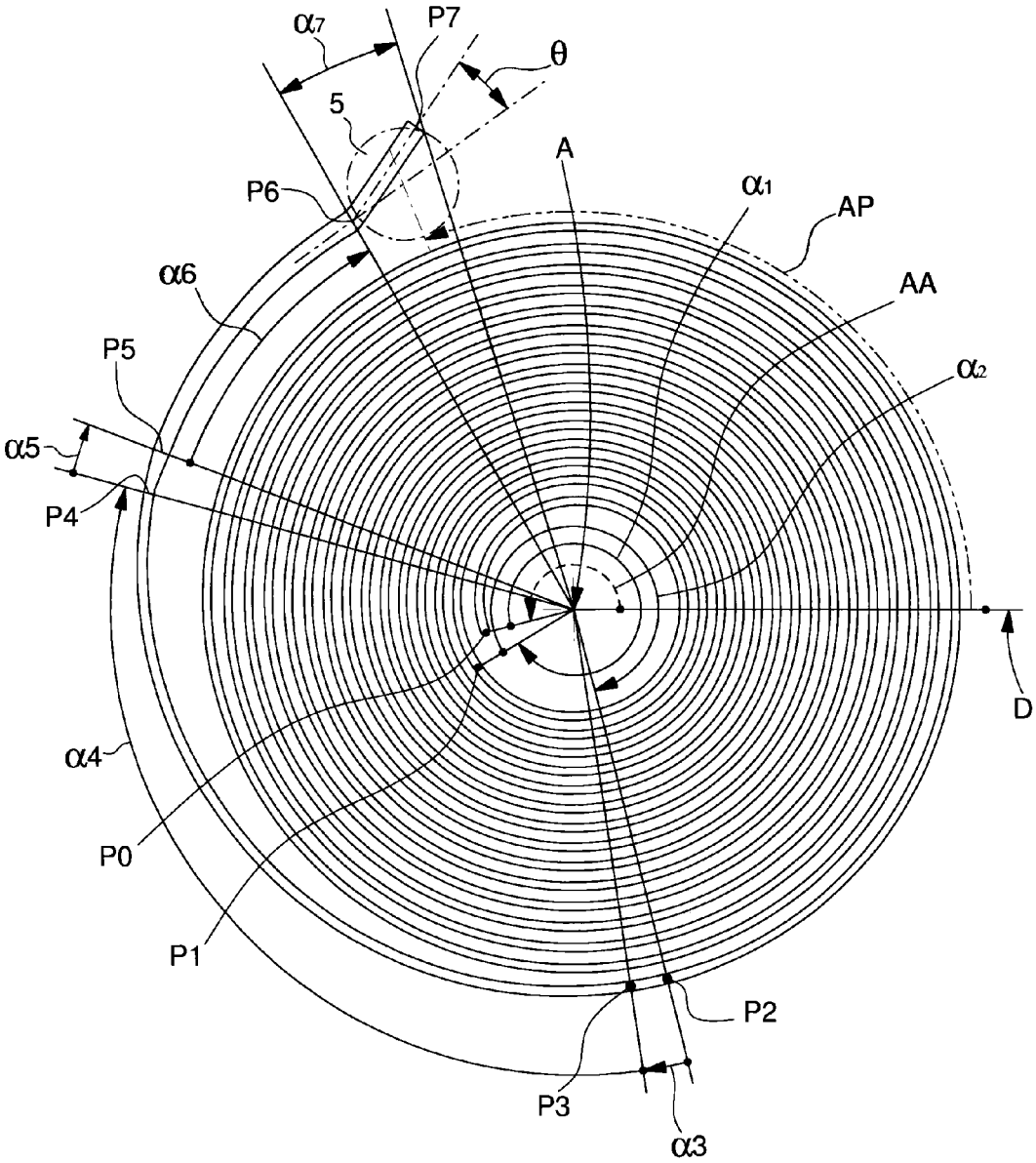
FIG. 2 shows a schematic view similar to FIG. 1 of a variant of the balance spring of FIG. 1 including, at its outer distal end, a linear segment for attachment to the stud.

In a variant illustrated in FIG. 2, this balance spring 1 also includes a seventh segment between said sixth point P6 and a seventh point P7, at a seventh angle at the center $\alpha$7, of greater or equal section to that of the sixth coil at the sixth point P6, deviating from the preceding coils, and forming with the tangent of the sixth coil at sixth point P6 an angle of deviation e.

Preferably, the first ratio R1 is comprised between 0.90 and 0.95. More specifically, it is close to 0.92.

Preferably the third ratio R3 is comprised between 1.15 and 1.30. More specifically, it is close to 1.22.

Preferably, the fifth ratio R5 is comprised between 1.50 and 1.75. More specifically, it is close to 1.64.

Preferably, the sixth ratio R6 is comprised between 1.25 and 1.40. More specifically, it is close to 1.33.

Preferably, the first angle at the center $\alpha$1 is comprised between 340° and 350°. More specifically, it is close to 344°.

Preferably, the second angle at the center $\alpha$2 has the value of an integer number of turns of a regular spiral to which an angle of between 285° and 295° is added.

Preferably the integer number of turns is thirteen, and more specifically the added angle is close to 292°.

Preferably, the third angle at the center $\alpha$3 is comprised between 3° and 7°. More specifically, it is close to 5°.

Preferably, the fourth angle at the center $\alpha$4 is comprised between 115° and 130°. More specifically, it is close to 122°.

Preferably, the fifth angle at the center $\alpha$5 is comprised between 3° and 7°. More specifically, it is close to 5°.

Preferably, the sixth angle at the center $\alpha$6 is comprised between 30° and 50°. More specifically, it is close to 40°.

Preferably, in the variant of FIG. 2, the seventh segment extends into an area swept by a seventh angle at the center $\alpha$7 comprised between 20° and 25°, and the angle of deviation $\ominus$ comprised between 45° and 65°. More specifically, the seventh angle at the center $\alpha$7 is close to 22°. More specifically, the angle of deviation $\ominus$'is close to 55°.

Preferably, balance spring 1 is of constant height in an axial direction A, said height being comprised between 0.14 mm and 0.16 mm.

Preferably, in the free state, the inner radius of balance spring 1, on the first inner coil, is comprised between 0.45 and 0.55 mm, and its outer radius on the sixth outer coil is comprised between 2.70 and 2.80 mm.

The invention also concerns an improved timepiece balance spring 1, characterized in that said balance spring 1 includes in succession and forming a continuous band, from an upstream inner end, an inner coil of decreasing section between a first section at its inner end and a second section at its junction with the next coil and said inner coil developing over less than one turn, followed by a series of coils whose second coil is of greater or equal section to said second section, and wherein at least one of said coils is of increasing section, and characterized in that said balance spring 1 includes, in succession, from an inner end P0 and with angles at the center relative to an axial reference A which are tangent to each other and all having a concavity facing said axial reference A and forming a continuous band:

- a first inner coil to a first point P1, at a first angle at the center α1 and of decreasing section in a first ratio R1;
- a second coil to a second point P2, at a second angle at the center α2 and of constant section;
- a third coil to a third point P3, at a third angle at the center α3 and of increasing section in a third ratio R3;
- a fourth coil to a fourth point P4, at a fourth angle at the center α4 and of constant section;
- a fifth coil to a fifth point P5, at a fifth angle at the center α5 and of increasing section in a fifth ratio R5;
- a sixth outer coil to a sixth point P6, at a sixth angle at the center α6 and of increasing section in a sixth ratio R6, characterized in that said balance spring 1 can be divided and for this purpose includes fracture lines 15 arranged to reduce its length, at the distal outer end 11 of its outer coil 12, which is formed, either by said sixth outer coil, or by a seventh segment comprised in said balance spring 1 between said sixth point P6 and a seventh point P7, at a seventh angle at the center α7, of greater or equal section to that of said sixth coil at said sixth point P6, deviating from the preceding coils, and forming an angle of deviation ⊖ with the tangent of said sixth coil at said sixth point P6.

These fracture lines 15 are arranged to reduce the length of the balance spring for adjustment of its attachment to a stud 5.

In an advantageous variant, balance spring 1 is in one piece, made of single crystal silicon with a Young's modulus E of between 140000 N/mm$^2$ and 150000 N/mm$^2$ and having a density ρ comprised between 2.30 g/cm$^3$ and 2.40 g/cm$^3$.

In another variant, balance spring 1 is in one piece, made of silicon oxide or single crystal quartz or polycrystalline quartz or single crystal diamond or polycrystalline diamond.

The invention further concerns a timepiece movement 100 including a control stem 3 defining an oriented direction D, a main plate 4 carrying a stud 5 and means for guiding at least one sprung balance regulating mechanism pivoting about an axis A. This regulating mechanism includes at least one such balance spring 1.

In a particular embodiment, this balance spring 1 is attached to stud 5 on a distal outer end 11 of its outer coil 12, at a point forming, with oriented direction D, an angle of attachment to the stud AP. Balance spring 1 is fixed to a balance collet 19 by an inner point of attachment 13 at the end of its inner coil 14, this point of inner attachment 13 forming with oriented direction D an angle of attachment AA in the position of equilibrium of the balance.

In a particular preferred embodiment, for a balance with an inertia of 21 mg·cm$^2$ and for a sprung balance assembly oscillating at 4 Hz, angle of attachment AA is comprised between 180° and 200°, and the angle of attachment to the stud AP is comprised between 95 and 115°.

Figure 3:
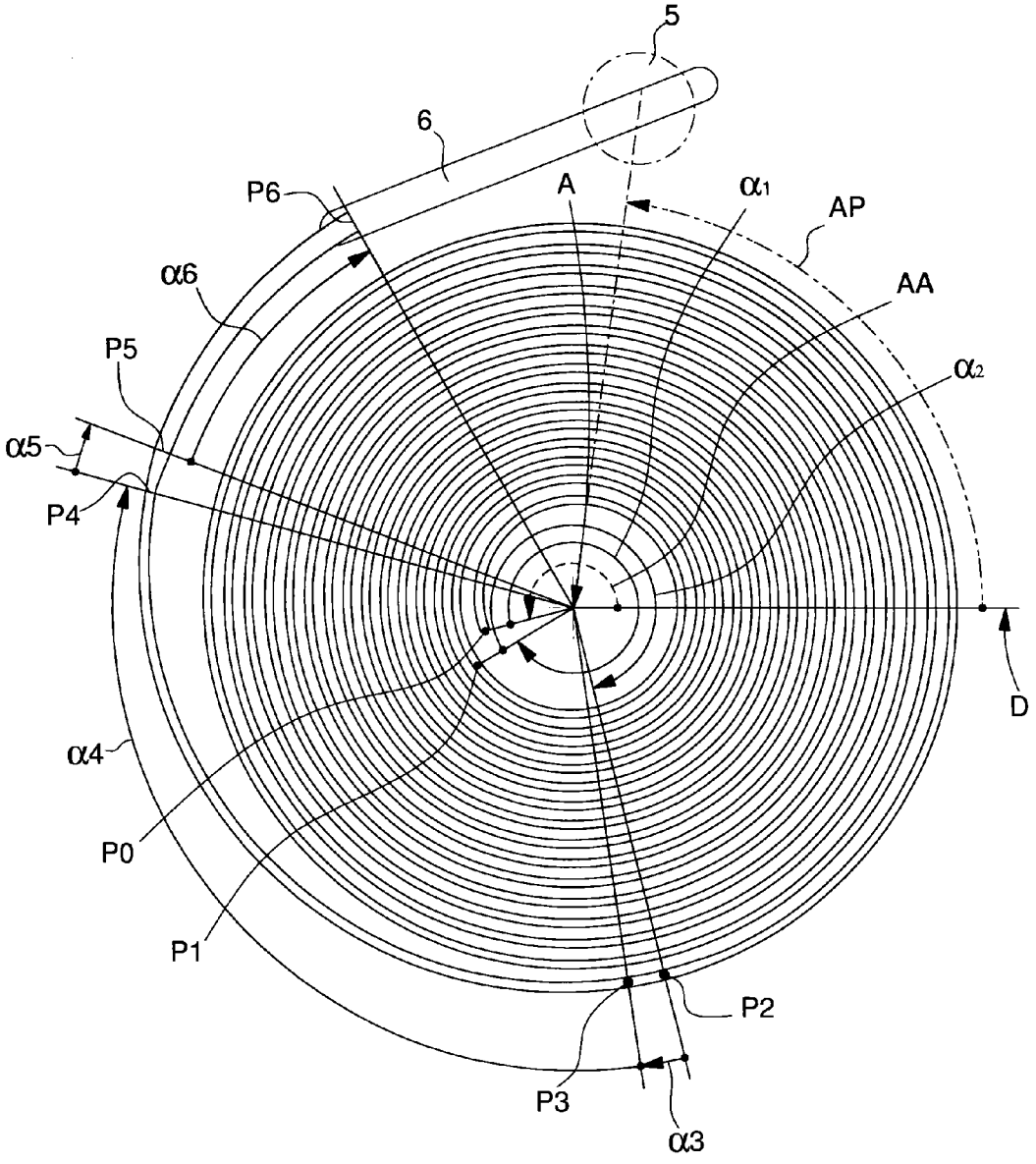
FIG. 3 shows a schematic view similar to FIG. 1 of the balance spring of FIG. 1, to which a separate element butts for the attachment of the balance spring to the stud.
Figure 4:
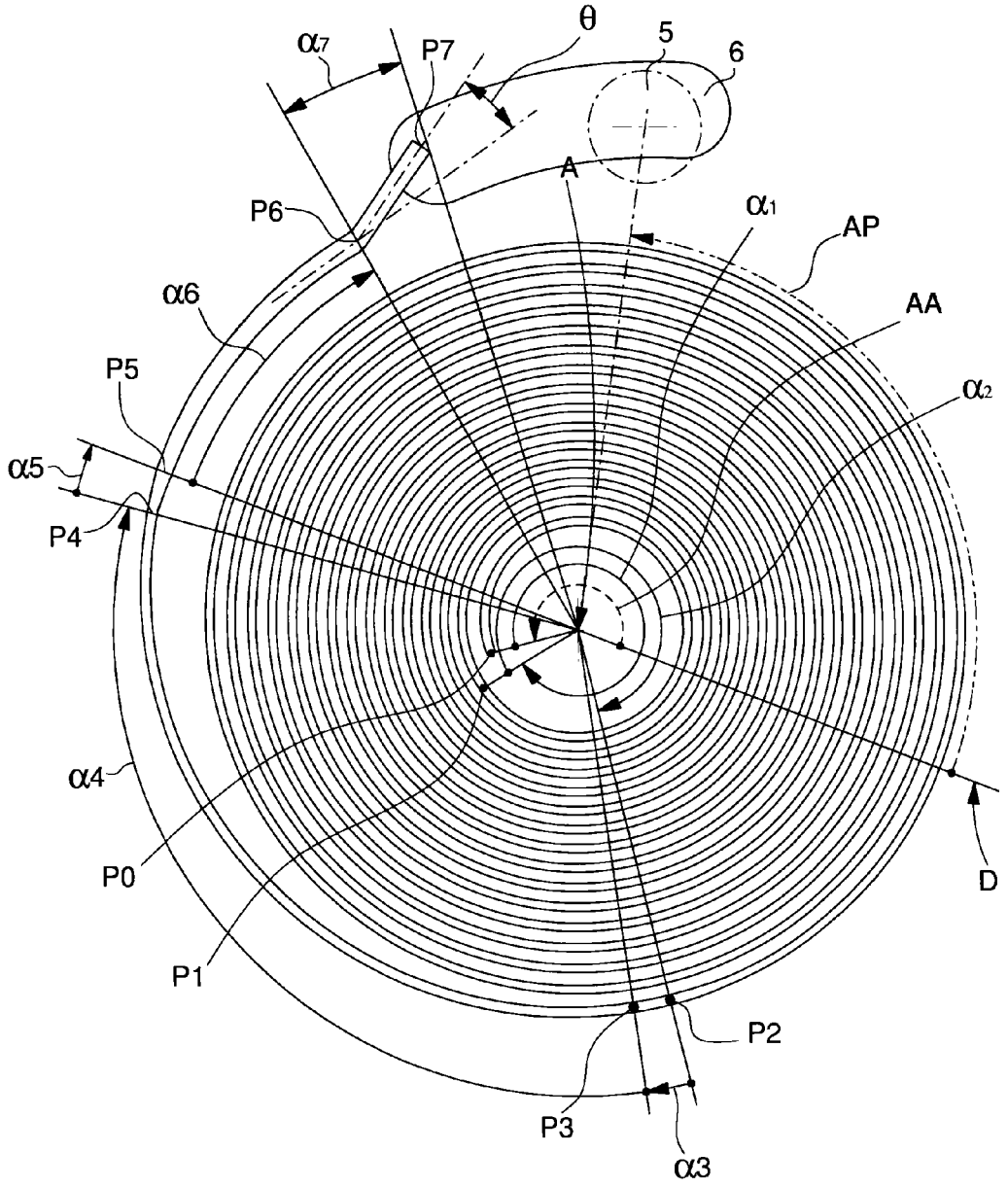
FIG. 4 shows a schematic view similar to FIG. 3 of the balance spring of FIG. 2, to which a separate element butts for the attachment of the balance spring to the stud.
Figure 5:
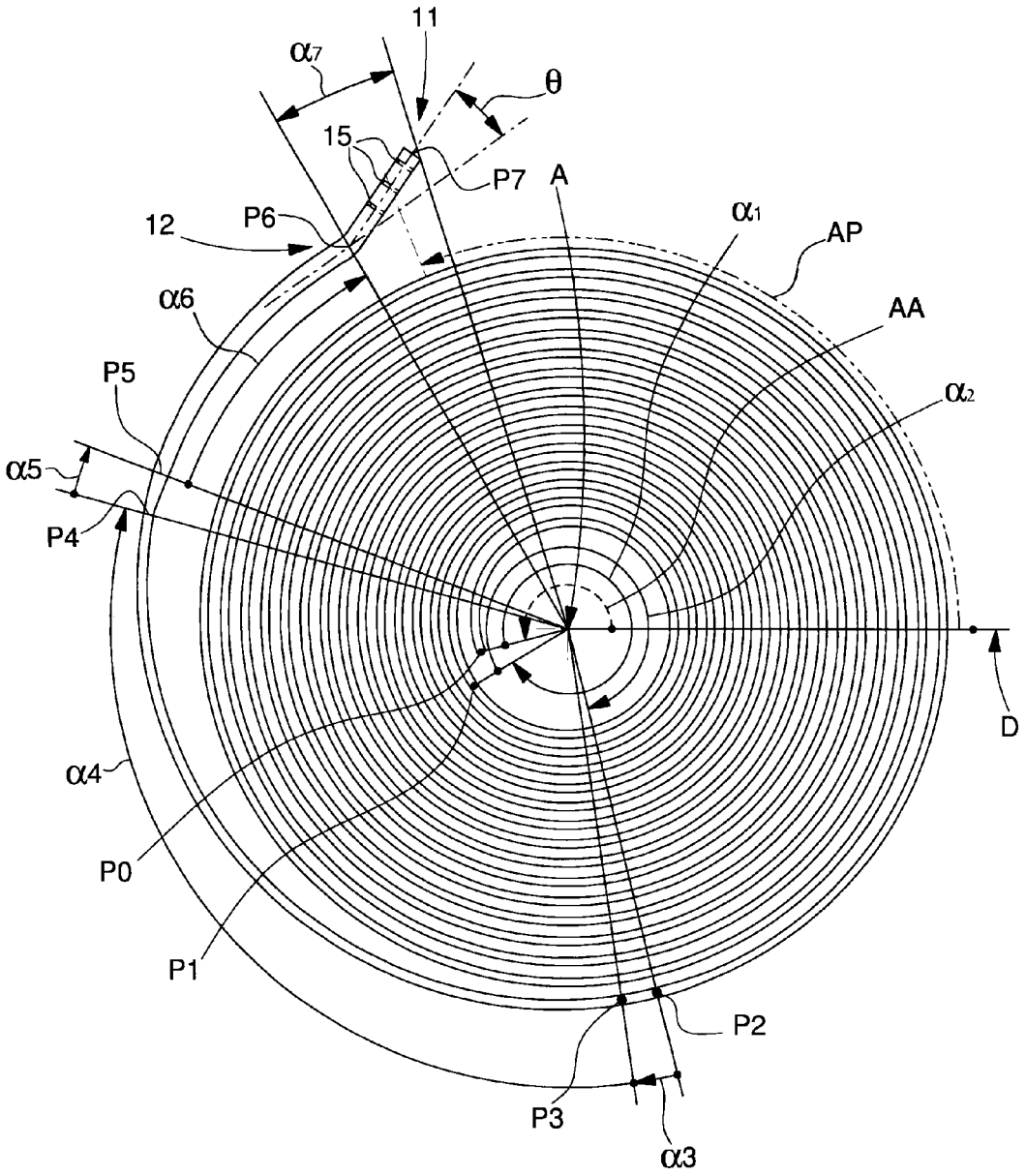
FIG. 5 shows a schematic view similar to FIG. 2 of the balance spring of FIG. 2 whose linear segment includes fracture lines for adjusting the attachment thereof to the stud.
Figure 6:
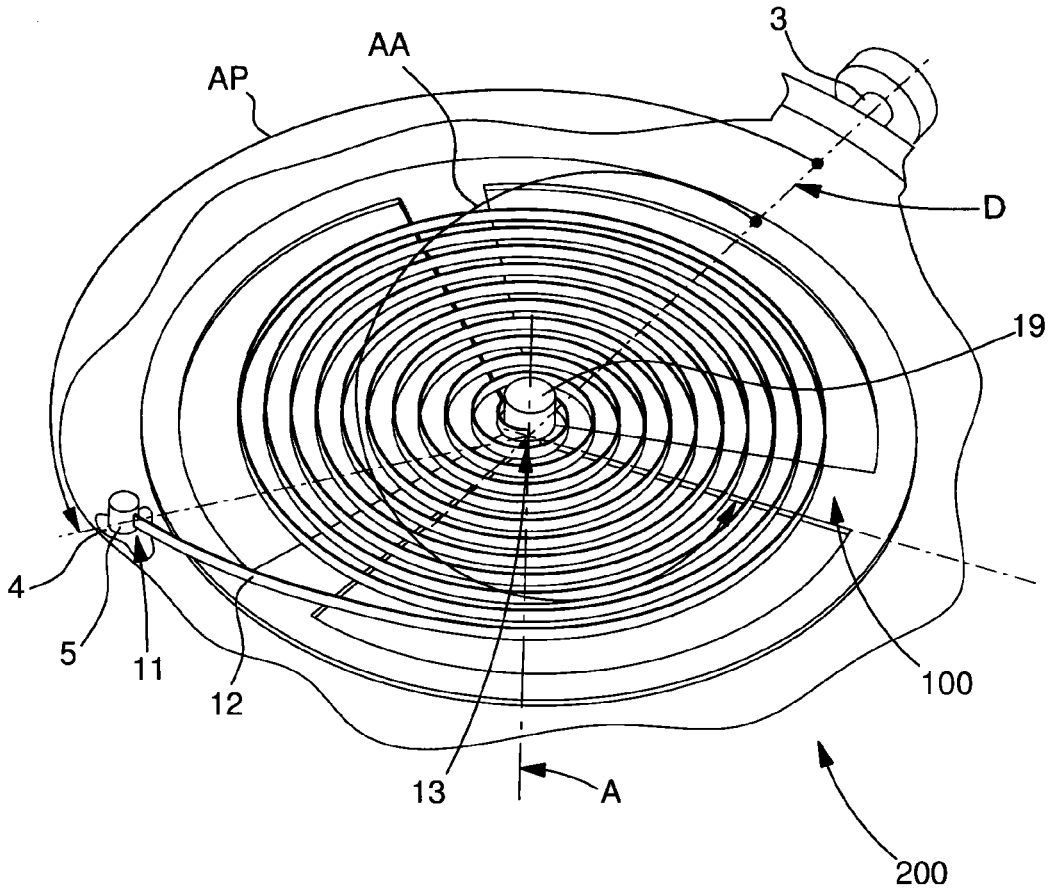
FIG. 6 shows a schematic, partial, perspective view of a watch including a movement comprising a sprung balance assembly incorporating a balance spring according to the invention.

In a particular variant illustrated in FIG. 3 or in FIG. 4, balance spring 1 is fixed to stud 5 by a separate element 6 butting said balance spring 1.

Preferably, this separate element 6 butting said balance spring 1 is made of the same material as balance spring 1, with the same Young's modulus E and the same density ρ, and is of higher rigidity than balance spring 1 at every point of outer coil 12 of balance spring 1.

The invention further concerns a watch 200 including at least one sprung balance regulating mechanism pivoting about an axis A including at least one such balance spring 1, and/or said watch 200 includes at least one such movement 100.

In a silicon or <<MEMS>> or <<LIGA>> technology, or similar, it is easy to manufacture a balance spring of this type, and particularly with separable parts, which permits the use of the same basic balance spring for different movements, in watches having different configurations, particularly hunting watches or Lépine pocket watches. It is also easy to reduce the new end plate to a skeleton to decrease its mass.

What is claimed is:

1. A balance spring, wherein said balance spring includes, in succession and forming a continuous band, from an upstream inner end, an inner coil of decreasing section, and wherein said balance spring includes, in succession, from an inner end and with angles at the center relative to an axial reference which are tangent to each other and all having a concavity facing said axial reference, and forming a continuous band:

- a first inner coil to a first point, at a first angle at the center and of decreasing section in a first ratio;
- a second coil to a second point, at a second angle at the center and of constant section;
- a third coil to a third point, at a third angle at the center and of increasing section in a third ratio;
- a fourth coil to a fourth point, at a fourth angle at the center and of constant section;
- a fifth coil to a fifth point, at a fifth angle at the center and of increasing section in a fifth ratio;
- a sixth outer coil to a sixth point, at a sixth angle at the center and of increasing section in a sixth ratio.

2. The balance spring according to claim 1, wherein said balance spring also includes a seventh segment between said sixth point and a seventh point, at a seventh angle at the center, of greater or equal section to that of said sixth coil at said sixth point, deviating from the preceding coils, and forming with the tangent of said sixth coil at said sixth point an angle of deviation.

3. The balance spring according to claim 1, wherein said first ratio is comprised between 0.90 and 0.95.

4. The balance spring according to claim 1, wherein said third ratio is comprised between 1.15 and 1.30.

5. The balance spring according to claim 1, wherein said fifth ratio is comprised between 1.50 and 1.75.

6. The balance spring according to claim 1, wherein said sixth ratio is comprised between 1.25 and 1.40.

7. The balance spring according to claim 1, wherein said first angle at the center is comprised between 340° and 350°.

8. The balance spring according to claim 1, wherein said second angle at the center has the value of an integer number of turns of a regular spiral to which an angle of between 285° and 295° is added.

9. The balance spring according to claim 8, wherein the integer number of turns is thirteen.

10. The balance spring according to claim 1, wherein said third angle at the center is comprised between 3° and 7°.

11. The balance spring according to claim 1, wherein said fourth angle at the center is comprised between 115° and 130°.

12. The balance spring according to claim 1, wherein said fifth angle at the center is comprised between 3° and 7°.

13. The balance spring according to claim 1, wherein said sixth angle at the center is comprised between 30° and 50°.

14. The balance spring according to claim 1, wherein said balance spring also includes a seventh segment between said sixth point and a seventh point, at a seventh angle at the center, comprised between 20° and 25° , of greater or equal section to that of said sixth coil at said sixth point, and forming with the tangent of said sixth coil at said sixth point an angle of deviation of between 45° and 65°.

15. The balance spring according to claim 1, wherein said balance spring is of constant height in an axial direction, said height being comprised between 0.14 mm and 0.16 mm.

16. The balance spring according to claim 1, wherein, in the free state, the inner radius thereof on said first coil is comprised between 0.45 and 0.55 mm, and in that the outer radius thereof on said sixth coil is comprised between 2.70 and 2.80 mm.

17. The balance spring according to claim 1, wherein said balance spring is in one piece, made of single crystal silicon with a Young's modulus of between 140000N/mm2 and 150000N/mm2 and having a density comprised between 2.30g/cm3 and 2.40g/cm3.

18. The balance spring according to claim 1, wherein said balance spring is in one piece, made of silicon oxide or single crystal quartz or polycrystalline quartz or single crystal diamond or polycrystalline diamond.

19. A timepiece movement including a control stem defining an oriented direction, a main plate carrying a stud and means for guiding at least one sprung balance regulating mechanism pivoting about an axis and said sprung balance includes at least one said balance spring according to claim 1.

20. The movement according to claim 19, wherein said balance spring is attached to said stud on a distal outer end of the outer coil at a point forming with said oriented direction an angle of attachment to the stud, said balance spring being fixed to a balance collet by an inner point of attachment at the end of the inner coil thereof, said inner point of attachment forming with said oriented direction an angle of attachment in the position of equilibrium of said balance, wherein said angle of attachment is comprised between 180° and 200° and in that said angle of attachment to the stud is comprised between 95° and 115°.

21. The movement according to claim 19, wherein said balance spring is fixed to said stud by a separate element butting said balance spring.

22. The movement according to claim 20, wherein said separate element butting said balance spring is made of the same material as said balance spring, with the same Young's modulus and the same density, and is of higher rigidity than said balance spring at every point of said outer coil of said balance spring.

23. A watch including at least one sprung balance regulating mechanism pivoting about an axis and said sprung balance including at least one said balance spring according to claim 1.

24. An improved timepiece balance spring, wherein said balance spring includes in succession and forming a continuous band, from an upstream inner end, an inner coil of decreasing section between a first section at the inner end and a second section at the junction thereof with the next coil and said inner coil developing over less than one turn, followed by a series of coils whose second coil is of greater or equal section to said second section, and wherein at least one of said coils is of increasing section, and wherein said balance spring includes, in succession, from an inner end and with angles at the center relative to an axial reference which are tangent to each other and all having a concavity facing said axial reference and forming a continuous band:

- a first inner coil to a first point, at a first angle at the center and of decreasing section in a first ratio;
- a second coil to a second point, at a second angle at the center and of constant section;
- a third coil to a third point, at a third angle at the center and of increasing section in a third ratio;
- a fourth coil to a fourth point, at a fourth angle at the center and of constant section;
- a fifth coil to a fifth point, at a fifth angle at the center and of increasing section in a fifth ratio;
- a sixth outer coil to a sixth point, at a sixth angle at the center and of increasing section in a sixth ratio, wherein said balance spring can be divided and for this purpose includes fracture lines arranged to reduce the length thereof, at the distal outer end of the outer coil, which is formed, either by said sixth outer coil, or by a seventh segment comprised in said balance spring between said sixth point and a seventh point, at a seventh angle at the center, of greater or equal section to that of said sixth coil at said sixth point, deviating from the preceding coils, and forming an angle of deviation with the tangent of said sixth coil at said sixth point.

25. The balance spring according to claim 24, wherein said balance spring is in one piece, made of single crystal silicon with a Young's modulus of between 140000N/mm2 and 150000 N/mm2 and having a density comprised between 2.30 g/cm3 and 2.40 g/cm3.

26. The balance spring according to claim 24, wherein said balance spring is in one piece, made of silicon oxide or single crystal quartz or polycrystalline quartz or single crystal diamond or polycrystalline diamond.

27. A timepiece movement including a control stem defining an oriented direction, a main plate carrying a stud and means for guiding at least one sprung balance regulating mechanism pivoting about an axis and said sprung balance includes at least one said balance spring according to claim 24.

28. The movement according to claim 27, wherein said balance spring is attached to said stud on a distal outer end of the outer coil at a point forming with said oriented direction an angle of attachment to the stud, said balance spring being fixed to a balance collet by an inner point of attachment at the end of the inner coil thereof, said inner point of attachment forming with said oriented direction an angle of attachment in the position of equilibrium of said balance, wherein said angle of attachment is comprised between 180° and 200° and in that said angle of attachment to the stud is comprised between 95° and 115°.

29. The movement according to claim 27, wherein said balance spring is fixed to said stud by a separate element butting said balance spring.

30. The movement according to claim 28, wherein said separate element butting said balance spring is made of the same material as said balance spring, with the same Young's modulus and the same density, and is of higher rigidity than said balance spring at every point of said outer coil of said balance spring.

* * * * *